US007219616B2

(12) United States Patent
Pritchett

(10) Patent No.: US 7,219,616 B2
(45) Date of Patent: May 22, 2007

(54) PROTECTIVE COVER FOR A WINDSHIELD OF A BOAT

(76) Inventor: Daniel F. Pritchett, 205 Sunrise Dr., Sun Valley, ID (US) 83353

( * ) Notice: Subject to any disclaimer, the term of this patent is extended or adjusted under 35 U.S.C. 154(b) by 797 days.

(21) Appl. No.: 10/106,815

(22) Filed: Mar. 25, 2002

(65) Prior Publication Data

US 2005/0098080 A1 May 12, 2005

(51) Int. Cl.
*B63B 17/00* (2006.01)

(52) U.S. Cl. ..... 114/361; 150/168

(58) Field of Classification Search ..... 114/361; 150/154, 166, 168
See application file for complete search history.

(56) References Cited

U.S. PATENT DOCUMENTS 4,726,406 A * 2/1988 Weatherspoon ..... 150/168
5,738,403 A * 4/1998 Tyson ..... 296/136.02
6,241,303 B1 * 6/2001 Yee ..... 296/95.1
2003/0024620 A1 * 2/2003 Haberkorn ..... 150/154

FOREIGN PATENT DOCUMENTS

EP 0 052 563 * 5/1982

* cited by examiner

*Primary Examiner*—Sherman Basinger
(74) *Attorney, Agent, or Firm*—W. Edward Johansen

(57) ABSTRACT

A protective cover for a boat having a deck, a windshield with a top peripheral edge and a bottom peripheral edge and a plurality of twist stud fasteners includes an inner layer, a center layer and an outer layer. The inner and outer layers are constructed of a water-resistant material. The center layer is constructed of a shock and impact absorbing material having a nominal thickness in the range of 0.25 inch to 0.50 inch. The inner layer, the center layer and the outer layer form a sandwich that has a peripheral edge that has a top portion and a bottom portion. The protective cover is attached to the windshield of the boat by placing it on the windshield.

3 Claims, 1 Drawing Sheet

Fig. 1.
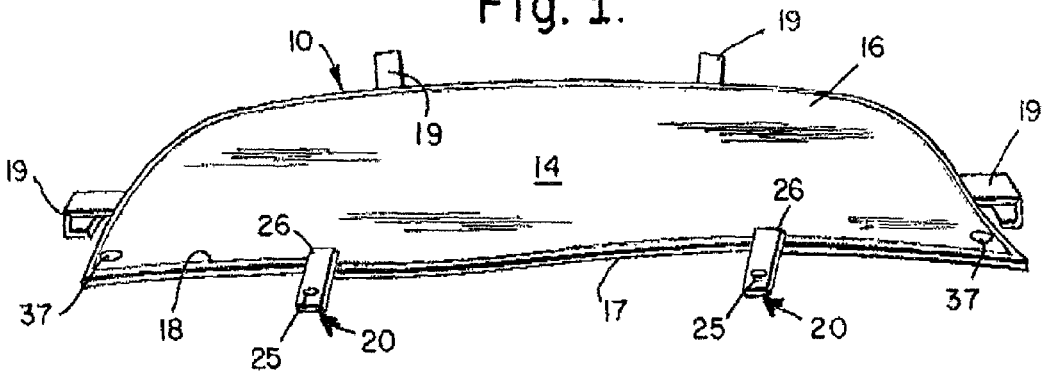
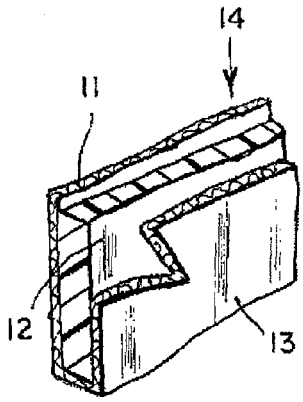
Fig. 2.
Fig. 4.
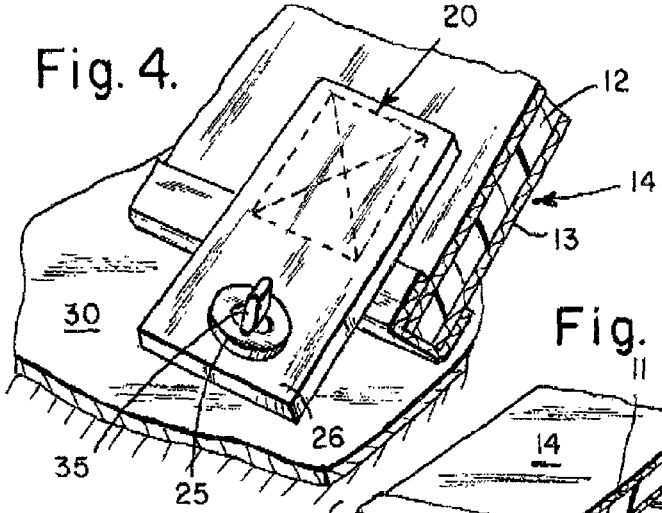
Fig. 3.
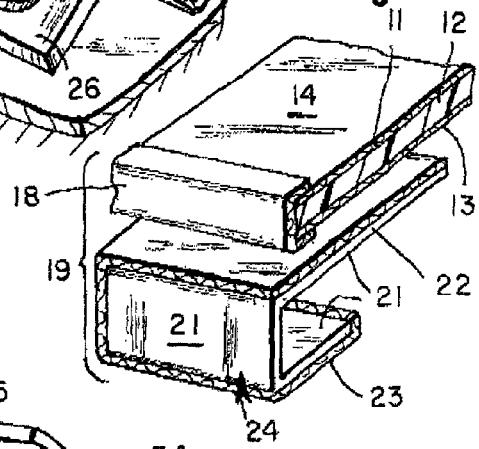
Fig. 5.
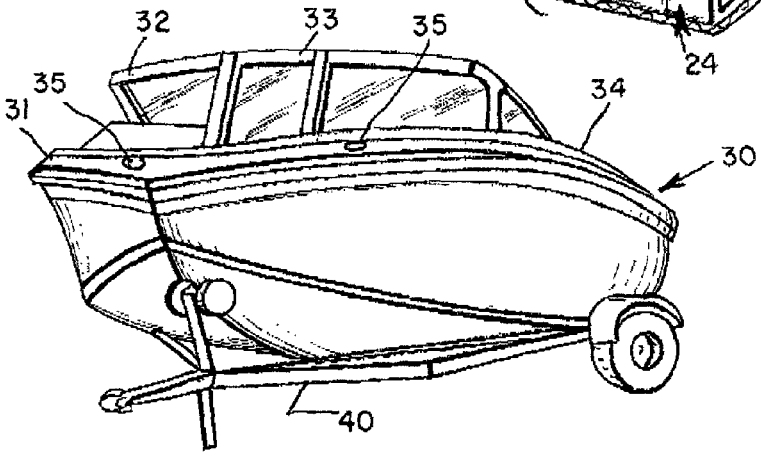

PROTECTIVE COVER FOR A WINDSHIELD OF A BOAT

BACKGROUND OF THE INVENTION

The invention relates to protective covers for a windshield of a boat.

U.S. Pat. No. 5,291,848 teaches a flexible hood structure that is secured about a bow portion of a boat. The hood includes a top wall having a slot that extends from the rear edge of the hood. A slot is directed into a sidewall below the slot of the top wall. The slots of the top wall and the sidewall accommodate boats of various sizes. Tether lines extend from a rear edge of the hood and are secured to an associated trailer of the boat structure. An opening that is directed through the side wall in adjacency to the nose portion of the top wall is arranged to receive a boat securing loop therethrough and to permit imposing of the cradle block structure of the trailer against the associated bow of the boat. There is a flexible windshield web. A connector of the top wall is mounted to the top wall for securing the windshield web. The windshield web includes a fastener member that is secured to the windshield web spaced from the connector of the top wall. The windshield web fastener member is arranged for securing the windshield web to a windshield of the boat.

U.S. Pat. No. 4,960,066, U.S. Pat. No. 5,076,195, U.S. Pat. No. 3,898,947, U.S. Pat. No. 4,233,414 and U.S. Pat. No. 4,815,412 teach boat cover structures that are attempts to overcome deficiencies of the prior art boat cover structures. These boat cover structures have not provided a structure for covering the bow portion of a boat in order afford protection to the bow portion of the boat during a trailer-procedure and prevent marring of the bow of the boat by debris that is generated by the trailer-procedure of the boat.

U.S. Pat. No. 5,820,196 and U.S. Pat. No. 5,845,958 teach a motor vehicle transport cover that is made of a vapor permeable, water impermeable, synthetic non-woven sheet. The transport cover includes a mechanism for firmly attaching the non-woven sheet in a position on a motor vehicle that covers substantially all of the roof, hood and front bumper fascia of the vehicle. The transport cover remains attached at an air speed along the major axis of the vehicle that is at least fifty miles per hour. The attachment mechanism is readily releasable and it leaves no visible adhesive residue on the vehicle at the moment the non-woven sheet is removed from the vehicle. The transport cover does not significantly inhibit access to the covered vehicle and it does not obstruct the view of a driver of the covered vehicle. The transport cover has a front sheet piece made to cover the hood of the covered vehicle and a top sheet piece made to cover the roof of the covered vehicle. Where the covered vehicle is a sedan, the transport cover may also cover the trunk and rear bumper of the vehicle.

U.S. Pat. No. 6,125,784 teaches a protective cover that includes a detachable and removable housing for protecting a personal watercraft. The protective cover is a molded reinforced fiberglass. The protective cover provides complete concealment and secure storage of the personal watercraft. The protective cover is designed to conform to the shape of the personal watercraft to provide full closure to cover as well as to store it in conjunction with a wheeled trailer for transporting, launching and retrieving the personal watercraft. The cover includes a watertight underside base portion surmounted by a top cover that has a rear portion connected to a front portion by a hinge. The rear portion of the top cover is capable of being raised and lowered to facilitate in the raised position the ingress and egress of the personal watercraft into and out of the housing. The front portion of the housing contains a lockable access hatch capable of being opened and closed to permit access to the interior of the housing. The upper surface of the base portion is configured to facilitate sliding movement of the personal watercraft into and out of the housing. There is a mechanism that secures the rear portion of the top cover to the base portion to house a personal watercraft in a secure and protected manner.

U.S. Pat. No. 5,738,403 teaches a protective cover 8 that includes a plurality of lightweight separable panels. The protective cover has been used to protect parked or stored vehicles from damage caused by environmental and weather conditions such as solar radiation, heat, pollution, dust, acid rain, sleet, hail, and flying objects that may be encountered either during violent or severe weather or from flying road debris. Although existing protective covers adequately protect against some of those conditions, most are not very effective at preventing damage to the exterior of the vehicle from hailstones and other hard objects. Those protective covers that are designed to protect against such hard objects are bulky and cumbersome, making installation and removal an arduous and a time consuming process. Such protective covers are difficult to store due to their bulk. Each panel includes an inner layer, a center layer and an outer layer. The inner layer is constructed of a water resistant woven, knit or cast nylon material such as 400-denier nylon pack cloth that will not damage the paint finish of the vehicle. The inner layer may be also constructed of cotton, polyester, or canvas cloth that will not harm the paint finish. The center layer may be constructed of a shock and impact absorbing material such as closed-cell polyurethane foam having a nominal thickness of about ¾ in. The outer layer may be constructed of water resistant nylon material such as 400-denier nylon pack cloth or polyester or canvas cloth. The windshield panel includes a front face and a rear face. A fastener strip extends along the upper edge and sides of a rear face and across the lower edge of the front face. The fastener strip across the lower edge of the front face engages the fastener strip on the rear face of the top section of each front panel when the cover is in the assembled condition.

U.S. Pat. No. 6,192,818 teaches a protective device for protecting the bow of a watercraft from damage caused by collisions of the watercraft with trailers, docks, the shore, other watercraft, debris in the water, and the like, which does not significantly alter the resulting hydrodynamic flow of water over the bow of a watercraft. The protective device includes a generally planar aliphatic transparent deformable urethane member and an adhesive securing the urethane member to the exterior surface of the bow of a watercraft.

U.S. Pat. No. 6,183,580 teaches a protective cover for protecting the exterior of a vehicle that includes the paint surfaces and glass surface of the vehicle from damage from rocks, insects, road tar, and other debris while driving. The protective cover includes a set of protective sheets with each protective sheet having front and back surfaces, and an outer perimeter. Each protective sheet is generally transparent to permit the passage of light therethrough between the front and back surfaces of the protective sheet. The back surface of each of the protective sheet is designed for attachment to an exterior surface of a vehicle.

U.S. Pat. No. 6,125,905 teaches protecting covers that are provided for glass windows. The protective covers include a fiber reinforced polymeric fabric flexible enough to be rolled upon themselves.

U.S. Pat. No. 6,092,856 teaches a canopy style trailer cover for protecting recreational vehicles mounted on a trailer that includes a plurality of U-shaped frame members, each having a pair of opposing arms that terminate at a distal end. The respective ends are pivotally joined to the side of a trailer. A cover member having a substantially semi-circular cross-sectional configuration is mounted over the frame members. The pivotable frame members allow the cover to be pivoted and collapsed toward the rear of the trailer in an according style fashion providing convenient access to the vehicle.

U.S. Pat. No. 5,879,044 teaches an apparatus for protecting a vehicle windshield that is light-weight and virtually undetectable when secured to a windshield and a method for removably securing the apparatus to an existing windshield. The apparatus includes a main body formed of a substantially thin, clear material, such as plexiglass, of a one-piece construction. The main body includes a top face and a bottom face and is structured and sized to lie in an overlying relation upon a vehicle windshield. The main body may be of generally flat rectangular configuration for use with flat windshields or curved rectangular configuration for use with curved windshields. The apparatus is removably secured to an existing windshield by applying an adhesive material to the main body and positioning the main body onto the windshield in overlying relation thereto. The bottom face of the main body is in substantially direct contact with the outer surface of the windshield.

U.S. Pat. No. 4,768,823 teaches a readily attachable and removable windshield protector that substantially covers and protects a windshield of a vehicle. The protector includes a flexible, transparent sheet conforming to the configuration of the windshield and only very slightly smaller than the windshield dimensions. The sheet includes a peripheral beading and is secured to the windshield with a windshield setting tape sandwiched between the sheet and the windshield immediately adjacent to the beading. The beading and the windshield setting tape cause the sheet to be spaced apart from the underlying windshield in order to promote the flexibility of the sheet and create an insulating air space. The sheet with the beading and the windshield setting tape is placed in an overlapping relation on the vehicle's windshield, and a silicone rubber seal is placed around the sheet and in contact with the windshield, thereby sealing the windshield protector against water intrusion. The seal may be peeled away from the windshield to remove the sheet from the windshield.

The inventor incorporates the teachings of the above-cited patents into this specification.

SUMMARY OF THE INVENTION

The present invention is generally directed to a protective cover for a windshield of a boat. The boat has a deck and a windshield with a top peripheral edge and a bottom peripheral edge.

In a first separate aspect of the present invention, the protective cover includes an inner layer, a center layer and an outer layer. The inner and outer layers are constructed of a water-resistant material. The center layer is constructed of a shock and impact absorbing material such as either closed foam rubber or closed-cell polyurethane oam having a nominal thickness in the range of 0.25 inch to 0.50 inch. The protective cover is flexible so that when it is placed onto the windshield it not only conforms to the shape of the windshield, but also becomes aerodynamic.

In a second separate aspect of the present invention, the protective cover includes a plurality of hooks and a plurality of connectors. Each hook is formed by a J-shaped, flat piece of a metal and encased by a first cloth strip and a second cloth strip. The first and second cloth strips are mechanically coupled together to form a sandwich that is mechanically coupled to the inner layer adjacent to the top portion of the peripheral edge.

In a third separate aspect of the present invention the deck has a plurality of twist stud fasteners disposed adjacent to the bottom peripheral edge of the windshield. The protective cover includes a plurality of connectors. Each connector includes a buttonhole member and a third cloth strip. The buttonhole member is mechanically coupled to the third cloth strip. The third cloth strip is mechanically coupled to the inner layer adjacent to said bottom portion of the peripheral edge. Each hook is mechanically coupled to the top peripheral edge of the windshield. Each twist stud fastener is placed into the buttonhole member of one of the connectors.

Other aspects and many of the attendant advantages will be more readily appreciated as the same becomes better understood by reference to the drawing and the following detailed description.

The features of the present invention which are believed to be novel are set forth with particularity in the appended claims.

DESCRIPTION OF THE DRAWINGS

FIG. 1 is an elevation of a protective cover for a windshield of a boat according to the present invention.

FIG. 2 is a first partial perspective drawing in cross-section of the protective cover of FIG. 1.

FIG. 3 is a second partial perspective drawing in cross-section of the protective cover of FIG. 1.

FIG. 4 is a third partial perspective drawing in cross-section of the protective cover of FIG. 2.

FIG. 5 is a perspective drawing of a boat on a trailer having a deck and a windshield to which the protective cover of FIG. 1 is attached.

DESCRIPTION OF THE PREFERRED EMBODIMENT

Referring to FIG. 1 in conjunction with FIG. 2 a protective cover 10 includes has an inner layer 11, a center layer 12 and a thinner outer layer 13 forming a sandwich 14 that has a peripheral edge 15. The peripheral edge 15 has a top portion 16 and a bottom portion 17. The sandwich 14 is customized to cover a specifically shaped windshield. A cloth band 18 encloses the sandwich 14 along its peripheral edge 15. The protective cover 10 also includes a plurality of hooks 19 and a plurality of connectors 20.

Referring to FIG. 2 the inner layer 11, the outer layer 13 and the cloth band 18 are constructed of a water-resistant thin, woven, knit or cast nylon material such as a 400-denier nylon pack-cloth. The inner layer 11, the outer layer 13 and the cloth band 18 may be also constructed of cotton, polyester, or canvas cloth. The center layer 12 is thicker than the inner and outer layers 11 and 13. The center layer is constructed of a shock and impact absorbing material, such as closed-cell polyurethane foam, having a nominal thickness in the range of 0.25 inch to 0.50 inch.

Referring to FIG. 3 in conjunction with FIG. 1 each hook 19 includes a J-shaped, flat piece 21 of a metal, such as aluminum, and is encased by a first cloth strip 22 and a second cloth strip 23. The first and second cloth strips 22 and 23 are mechanically coupled together, preferably by being sewn together, to form a sandwich 24. The sandwich 24 is mechanically coupled to sewn to the inner layer 11 adjacent to the top portion 16 of the peripheral edge 15.

Referring to FIG. 4 in conjunction with FIG. 1 each connector 20 includes a buttonhole member 25 and a third cloth-strip 26. The buttonhole member 25 is mechanically coupled to the third cloth strip 26. The third cloth strip 26 is mechanically coupled to the inner layer 11 adjacent to the bottom portion 17 of the peripheral edge 15, preferably by being sewn thereto.

Referring to FIG. 5 in conjunction with FIG. 1 a boat 30 has a deck 31 and a windshield 32 having a top peripheral edge 33 and a bottom peripheral edge 34. The boat 30 has a plurality of twist stud fasteners 35. Each twist stud fastener 35 is mounted on the deck 31 adjacent to the bottom peripheral edge 34 of the windshield 32. When the boat 30 is to be either mounted on a trailer 40 or moored to a dock the protective cover 10 is attached to the windshield 31 of the boat 30. The protective cover 10 is securely attached to the boat 30 in order to protect the windshield 31 not only from road debris when the boat 30 is being transported on a trailer 40, but also from inadvertent damage while the boat 30 is moored to a dock. The protective cover 10 protects the windshield 32 against environmental and weather conditions such as solar radiation, heat, pollution, dust, acid rain, sleet, hail and flying objects that may be encountered during violent or severe weather.

Still referring to FIG. 5 in conjunction with FIG. 1 the protective cover 10 is attached to the deck 31 of the windshield 32 of the boat 30. The protective cover 10 is placed it on the windshield 31 and each hook 19 is attached to the top peripheral edge of the windshield 32. Each twist stud fastener 35 is placed into the buttonhole member 25 of one of the connectors 20 of the protective cover 10.

There have been prior art protective covers that adequately protect against some of those conditions, but these protective covers are bulky and cumbersome, making installation and removal an arduous and a time consuming process. These protective covers are also difficult to store due to their bulk.

The protective cover 10 may include male and female corner fasteners 37 that are attached to either the deck 31 or the windshield 32 and the protective cover 10, respectively so that the protective cover 10 becomes aerodynamic. The corner fasteners 37 may be snap fasteners, velcro fasteners or twist stud fasteners and are attached to either the deck 31 or the windshield 32 and the protective cover 10, respectively.

From the foregoing it can be seen that a protective cover for a windshield of a boat has been described.

Accordingly it is intended that the foregoing disclosure and drawings shall be considered only as an illustration of the principle of the present invention.

What is claimed is:

1. A protective cover for a boat having a deck with a plurality of twist stud fasteners, a windshield with a top peripheral edge and a bottom peripheral edge, said protective cover comprising:

a. an inner layer constructed of a water-resistant material;

b. a center layer constructed of a shock and impact absorbing material;

c. an outer layer with said inner layer, said center layer and said outer layer forming a sandwich that has a peripheral edge that has a top portion and a bottom portion whereby said protective cover is attached to the windshield of the boat by placing it on the windshield;

d. a plurality of hooks each of which is formed by a J-shaped, flat piece of a metal and encased by a first cloth strip and a second cloth strip wherein said first and second cloth strips are mechanically coupled together to form a sandwich that is mechanically coupled to said inner layer adjacent to said top portion of said peripheral edge; and e. a plurality of connectors each of which is formed by a buttonhole and a third cloth strip wherein said buttonhole is mechanically coupled to said third cloth strip and said third cloth strip is mechanically coupled to said inner layer adjacent to said bottom portion of said peripheral edge whereby each of said hooks to the top peripheral edge of the windshield and placing each of said twist stud fasteners into the buttonhole of one of the connectors.

2. A protective cover for a boat according to claim 1 wherein said shock and impact absorbing material is closed-cell polyurethane foam having a nominal thickness in the range of 0.25 inch to 0.50 inch.

3. A protective cover for a boat having a deck with a plurality of twist stud fasteners, a windshield with a top peripheral edge and a bottom peripheral edge, said protective cover comprising:

a. an inner layer constructed of a water-resistant material;

b. a center layer constructed of a shock and impact absorbing material wherein said shock and impact absorbing material is closed-cell polyurethane foam having a nominal thickness in the range of 0.25 inch to 0.50 inch;

c. an outer layer with said inner layer, said center layer and said outer layer forming a sandwich that has a peripheral edge that has a top portion and a bottom portion whereby said protective cover is attached to the windshield of the boat by placing it on the windshield;

d. a plurality of hooks each of which is formed by a J-shaped, flat piece of a metal and encased by a first cloth strip and a second cloth strip wherein said first and second cloth strips are mechanically coupled together to form a sandwich that is mechanically coupled to said inner layer adjacent to said top portion of said peripheral edge; and e. a plurality of connectors each of which is formed by a buttonhole and a third cloth strip wherein said buttonhole is mechanically coupled to said third cloth strip and said third cloth strip is mechanically coupled to said inner layer adjacent to said bottom portion of said peripheral edge whereby each of said hooks to the top peripheral edge of the windshield and placing each of said twist stud fasteners into the buttonhole of one of the connectors.

* * * * *